US010960262B2

(12) United States Patent
Tsai

(10) Patent No.: US 10,960,262 B2
(45) Date of Patent: Mar. 30, 2021

(54) EXERCISING DEVICE THAT IS OPENED BY SIDEWARD ROTATION

(71) Applicant: Yu-Lun Tsai, Taichung (TW)

(72) Inventor: Yu-Lun Tsai, Taichung (TW)

( * ) Notice: Subject to any disclaimer, the term of this patent is extended or adjusted under 35 U.S.C. 154(b) by 0 days.

(21) Appl. No.: 16/458,323

(22) Filed: Jul. 1, 2019

(65) Prior Publication Data

US 2020/0047021 A1 Feb. 13, 2020

(30) Foreign Application Priority Data

Aug. 13, 2018 (TW) ..... 107128149 A

(51) Int. Cl.
*A63B 22/00* (2006.01)
*A63B 22/02* (2006.01)
*A63B 22/06* (2006.01)

(52) U.S. Cl.
CPC ..... *A63B 22/0046* (2013.01); *A63B 22/0076* (2013.01); *A63B 22/02* (2013.01); *A63B 22/0664* (2013.01); *A63B 2210/06* (2013.01); *A63B 2210/50* (2013.01)

(58) Field of Classification Search
CPC . A63B 22/0046; A63B 22/0076; A63B 22/02; A63B 22/0664; A63B 21/0605; A63B 2210/06; A63B 2210/50; A63B 60/38; A63B 60/56; A63B 69/20; A63B 69/34; A47C 19/00; A47B 49/00; A47B 49/004; A47B 46/005; A47B 81/00; B65D 43/18; B65D 43/16
USPC ..... 482/51
See application file for complete search history.

(56) References Cited

U.S. PATENT DOCUMENTS 3,010,775 A * 11/1961 Giovannelli ..... A63B 55/60 312/217
4,364,559 A * 12/1982 Valentine ..... A63B 21/055 482/130
2002/0091043 A1* 7/2002 Rexach ..... A63B 21/0626 482/98
2008/0163421 A1* 7/2008 Stonier ..... A47C 17/40 5/2.1
2009/0181833 A1* 7/2009 Cassidy ..... A63B 21/156 482/94
2010/0051505 A1* 3/2010 Thomas ..... A63B 55/00 206/745
2011/0088163 A1* 4/2011 Luft-Weissberg ..... A47C 17/52 5/2.1

(Continued)

*Primary Examiner* — Loan B Jimenez
*Assistant Examiner* — Thao N Do
(74) *Attorney, Agent, or Firm* — Alan D. Kamrath; Karin L. Williams; Mayer & Williams PC

(57) ABSTRACT

An exercising device includes a cabinet and an exercise apparatus. The cabinet includes a top plate, a bottom plate, at least one fixed side, and a movable side which enclose a receiving space. The at least one fixed side is secured between the top plate and the bottom plate. The movable side is provided with a fixing member. A pivot member extends through the fixing member, and is mounted between the top plate and the bottom plate. Thus, the fixing member is pivoted about the pivot member, such that the movable side is pivoted sideward, to close or open the receiving space The exercise apparatus is received in the receiving space when the movable side closes the receiving space, and is extended outward from the receiving space when the movable side opens the receiving space.

6 Claims, 13 Drawing Sheets

(56) References Cited

U.S. PATENT DOCUMENTS

| | | | | |
|---|---|---|---|---|
| 2012/0200213 | A1* | 8/2012 | Savage | E05B 65/006<br>312/326 |
| 2019/0126122 | A1* | 5/2019 | Vester | A63B 21/4029 |
| 2019/0166993 | A1* | 6/2019 | Siaperas | A63B 21/4033 |
| 2019/0387874 | A1* | 12/2019 | Held | A47B 49/004 |
| 2019/0387879 | A1* | 12/2019 | Innella | A47B 81/00 |

* cited by examiner

EXERCISING DEVICE THAT IS OPENED BY SIDEWARD ROTATION

BACKGROUND OF THE INVENTION

1. Field of the Invention

The present invention relates to an exercising device and, more particularly, to an exercising device that is opened by sideward pivot (or swivel) rotation.

2. Description of the Related Art

A conventional exercising device, such as a treadmill, a step machine, an elliptic exercise machine or the like, is used in the house to provide an exercising effect to the user. However, the conventional exercising device has a determined volume and occupies a larger space, such that it cannot be stored easily and conveniently, thereby greatly causing inconvenience to the user in storage of the exercising device. In addition, the conventional exercising device has an outstanding appearance that cannot mate or coordinate with that of the indoor appliances of the house. Further, dust easily accumulates on the conventional exercising device during a long period of time.

BRIEF SUMMARY OF THE INVENTION

The primary objective of the present invention is to provide an exercising device that is stored easily and conveniently and is adapted to function as a piece of furniture. The exercising device also has a dustproof function.

In accordance with the present invention, there is provided an exercising device comprising a cabinet, and an exercise apparatus mounted in the cabinet. The cabinet includes a top plate, a bottom plate, at least one fixed side, and a movable side. The cabinet has a receiving space defined between and enclosed by the top plate, the bottom plate, the at least one fixed side, and the movable side. The at least one fixed side of the cabinet has an upper end secured to the top plate, and a lower end secured to the bottom plate. The movable side of the cabinet is provided with a fixing member. A pivot member extends through the fixing member of the movable side, and is mounted between the top plate and the bottom plate. Thus, the fixing member of the movable side is pivoted about the pivot member, such that the movable side of the cabinet is pivoted sideward, to close or open the receiving space of the cabinet. The exercise apparatus is secured on the fixing member of the movable side. In practice, the exercise apparatus is received in the receiving space of the cabinet when the movable side of the cabinet closes the receiving space of the cabinet, and is extended and exposed outward from the receiving space of the cabinet when the movable side of the cabinet opens the receiving space of the cabinet.

According to the primary advantage of the present invention, when the user wishes to use the exercise apparatus, the movable side of the cabinet is pivoted sideward to open the receiving space of the cabinet, such that the user directly operates the exercise apparatus immediately, to perform a corresponding movement, so as to achieve an exercising effect.

According to another advantage of the present invention, when the exercise apparatus is not in use, the movable side of the cabinet is pivoted sideward to close the receiving space of the cabinet, and the exercise apparatus is stored in the receiving space of the cabinet, such that the exercising device functions as a piece of furniture.

According to a further advantage of the present invention, when the movable side of the cabinet closes the receiving space of the cabinet, the exercise apparatus is stored in the receiving space of the cabinet and protected by the movable side of the cabinet, to achieve dustproof and storage purposes, and to enhance the lifetime of the exercise apparatus.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
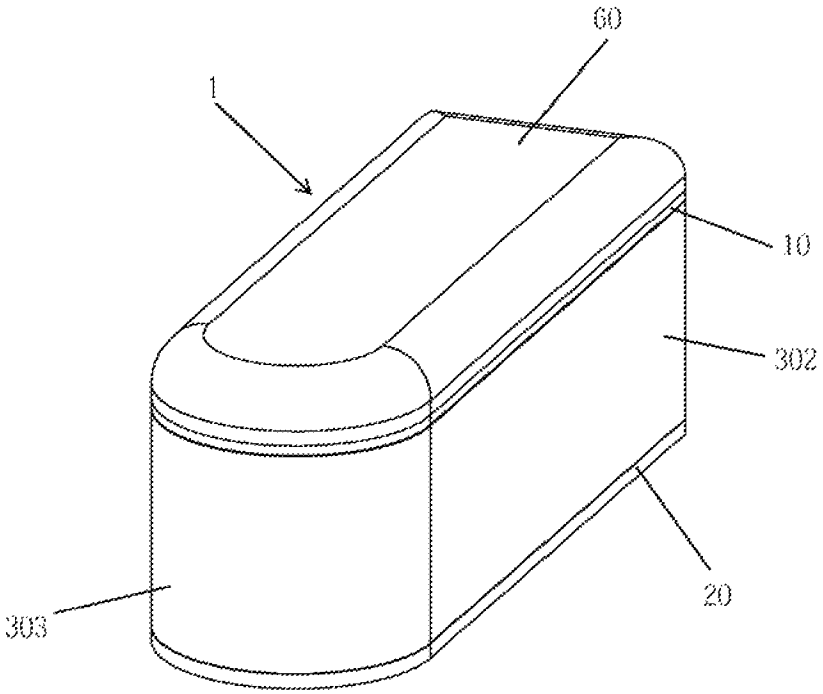
FIG. 1 is a perspective view of an exercising device in accordance with the preferred embodiment of the present invention.

Referring to the drawings and initially to FIGS. 1-4, an exercising device in accordance with the preferred embodiment of the present invention comprises a cabinet (or box) 1, and an exercise apparatus 80 mounted in the cabinet 1.

The cabinet 1 includes a top plate 10, a bottom plate 20, at least one fixed side 40, and a movable side 30. The cabinet 1 has a receiving space 50 defined between and enclosed by the top plate 10, the bottom plate 20, the at least one fixed side 40, and the movable side 30. The at least one fixed side 40 of the cabinet 1 has an upper end secured to the top plate 10, and a lower end secured to the bottom plate 20. The movable side 30 of the cabinet 1 is provided with a fixing member (or support board) 31. The fixing member 31 of the movable side 30 is disposed at a transverse state, and is located in the movable side 30. A pivot member (or pin) 32 extends through the fixing member 31 of the movable side 30, and is mounted between the top plate 10 and the bottom plate 20. The pivot member 32 of the movable side 30 is disposed at an upright state. Thus, the fixing member 31 of the movable side 30 is pivoted about the pivot member 32, such that the movable side 30 of the cabinet 1 is pivoted sideward relative to the top plate 10, the bottom plate 20, and the at least one fixed side 40, to close or open the receiving space 50 of the cabinet 1.

The exercise apparatus 80 is secured on the fixing member 31 of the movable side 30. In practice, the exercise apparatus 80 is received in the receiving space 50 of the cabinet 1 when the movable side 30 of the cabinet 1 closes the receiving space 50 of the cabinet 1, and is extended and exposed outward from the receiving space 50 of the cabinet 1 when the movable side 30 of the cabinet 1 opens the receiving space 50 of the cabinet 1.

In the preferred embodiment of the present invention, the exercising device further comprises a cushion 60 mounted on a top of the top plate 10.

In the preferred embodiment of the present invention, the cabinet 1 is made of wood, plastics, iron, glass or the like.

In the preferred embodiment of the present invention, the pivot member 32 has an upper end pivotally connected with the top plate 10, and a lower end pivotally connected with the bottom plate 20.

In the preferred embodiment of the present invention, the movable side 30 of the cabinet 1 includes a first side section 301, a second side section 302 connected with the first side section 301, and a third side section 303 connected with the second side section 302. The movable side 30 of the cabinet 1 has a movement (or motion or activity) space 33 defined between and enclosed by the first side section 301, the second side section 302, and the third side section 303. The exercise apparatus 80 is arranged in the movement space 33 of the movable side 30.

In the preferred embodiment of the present invention, the second side section 302 of the movable side 30 is perpendicular to the first side section 301, and is located between the first side section 301 and the third side section 303, and the third side section 303 of the movable side 30 has an arcuate shape.

In the preferred embodiment of the present invention, the exercise apparatus 80 includes an electronic instrument 81 pivotally and foldably mounted on a bottom of the top plate 10 of the cabinet 1.

In the preferred embodiment of the present invention, the exercise apparatus 80 is a rowing machine or a pull exercise machine.

Figure 2:
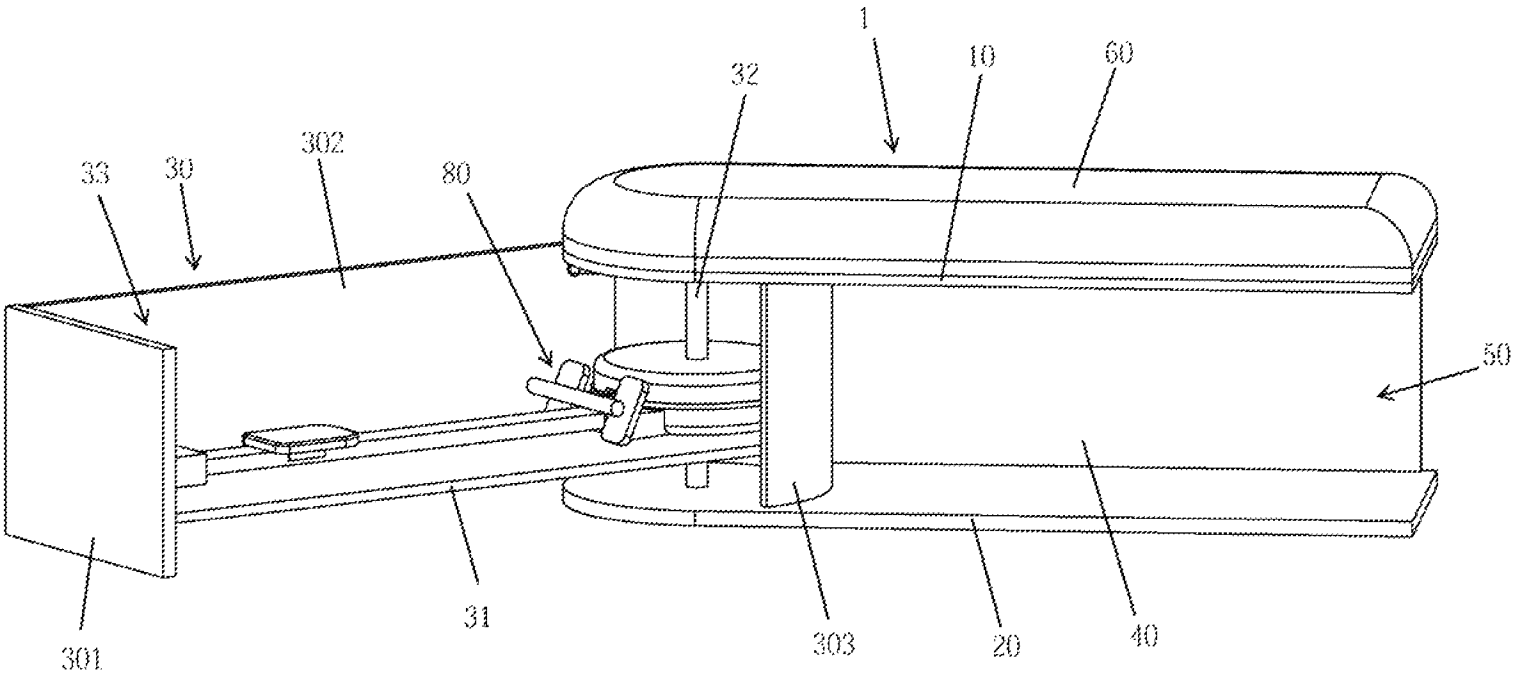
FIG. 2 is a perspective view showing opening of the exercising device as shown in FIG. 1.
Figure 3:
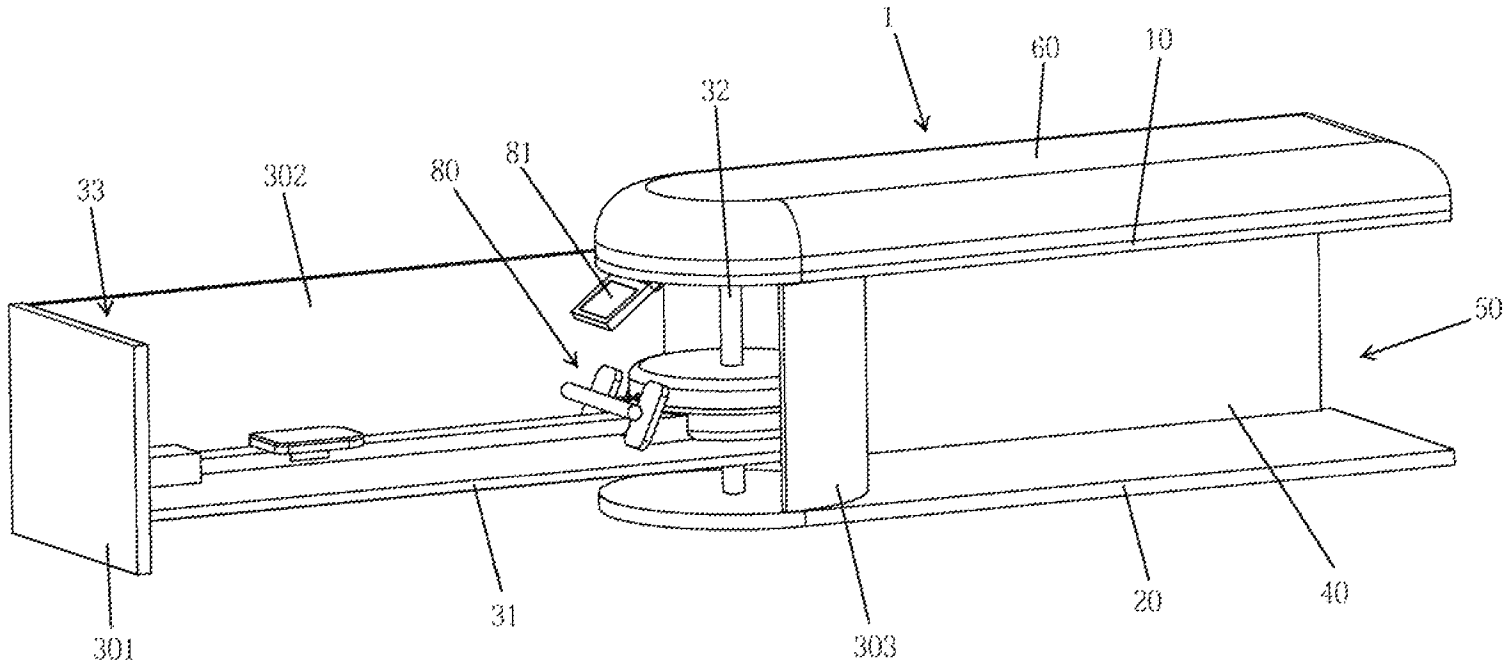
FIG. 3 is a perspective view showing operation of the exercising device as shown in FIG. 1.
Figure 4:
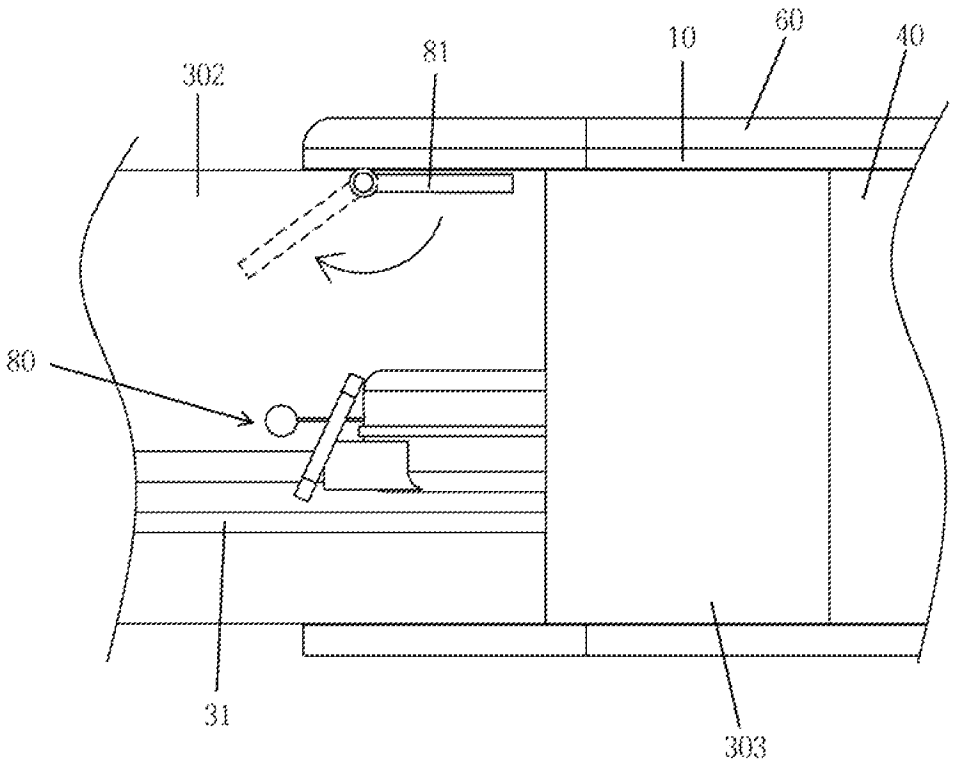
FIG. 4 is a locally enlarged side operation view of the exercising device as shown in FIG. 3.

In operation, referring to FIGS. 2-4 with reference to FIG. 1, when the movable side 30 of the cabinet 1 is pivoted sideward to open the receiving space 50 of the cabinet 1, the cabinet 1 is opened as shown in FIG. 2. Then, the electronic instrument 81 is pivoted and exposed outward from the top plate 10 of the cabinet 1 as shown in FIG. 3. Thus, the user directly operates the exercise apparatus 80 immediately, to perform a pulling or rowing movement, so as to achieve an exercising effect. At this time, the electronic instrument 81 indicates various values during movement of the exercise apparatus 80. After the user finishes exercising, the electronic instrument 81 is pivoted inward to abut the top plate 10 of the cabinet 1 as shown in FIG. 4. Then, the movable side 30 of the cabinet 1 is pivoted sideward to close the receiving space 50 of the cabinet 1, such that the exercise apparatus 80 is retracted into and received in the receiving space 50 of the cabinet 1, and the cabinet 1 is closed as shown in FIG. 1. Thus, the exercise apparatus 80 is stored in the cabinet 1 when not in use, such that the exercising device functions as a piece of furniture, such as a cabinet, a bed or a chair by provision of the cushion 60.

Figure 5:
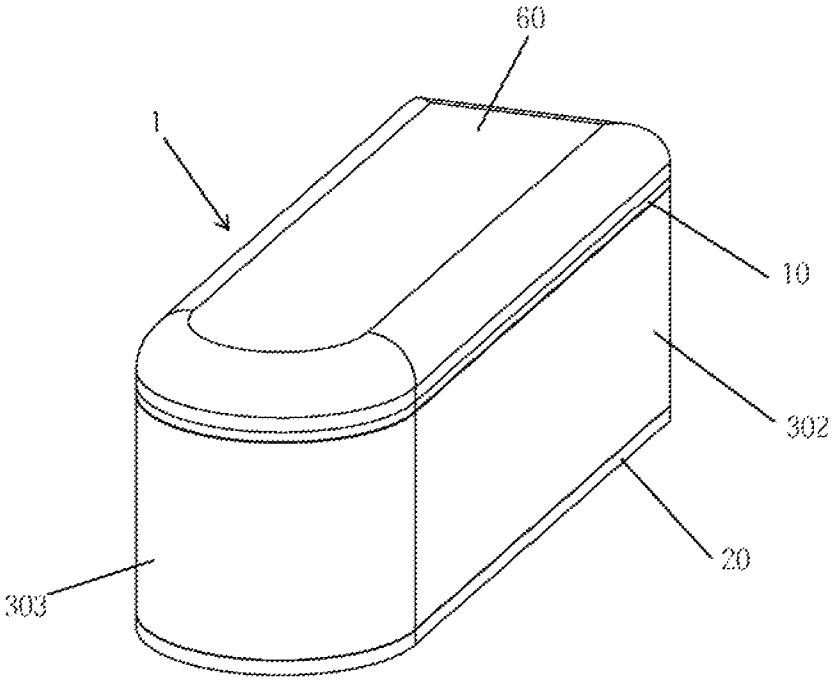
FIG. 5 is a perspective view of an exercising device in accordance with another preferred embodiment of the present invention.
Figure 6:
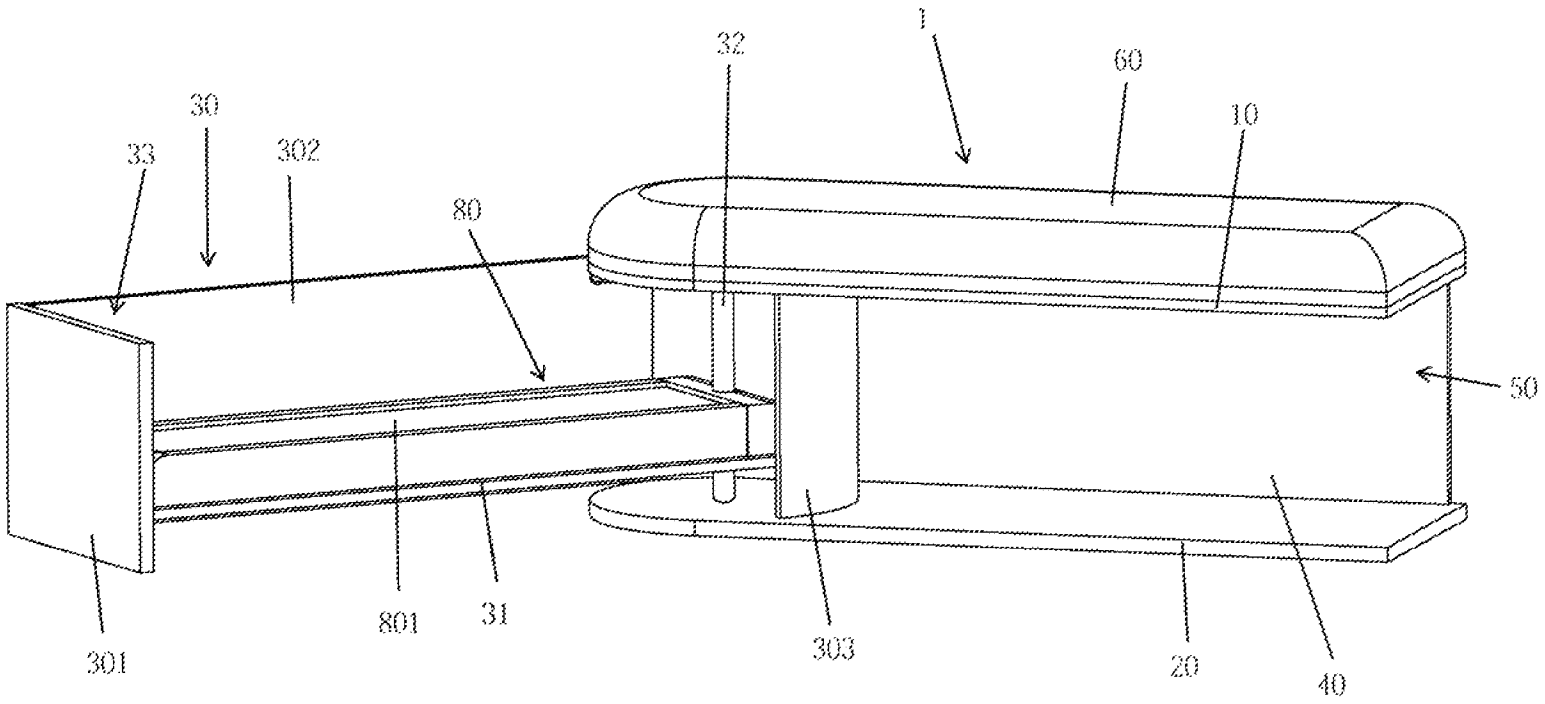
FIG. 6 is a perspective view showing opening of the exercising device as shown in FIG. 5.
Figure 7:
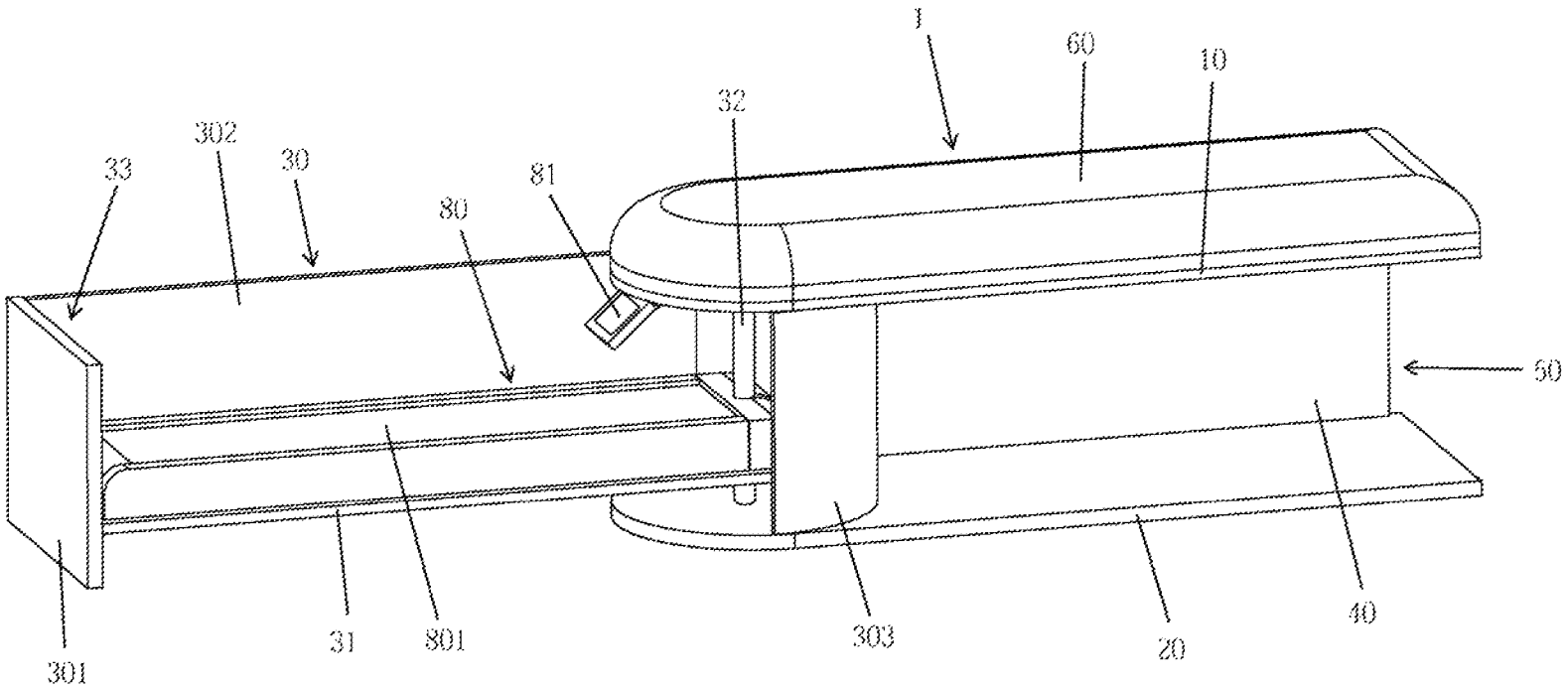
FIG. 7 is a perspective view showing operation of the exercising device as shown in FIG. 5.

Referring to FIGS. 5-7, the exercise apparatus 80 is preferably a treadmill with a rotary belt 801.

Figure 8:
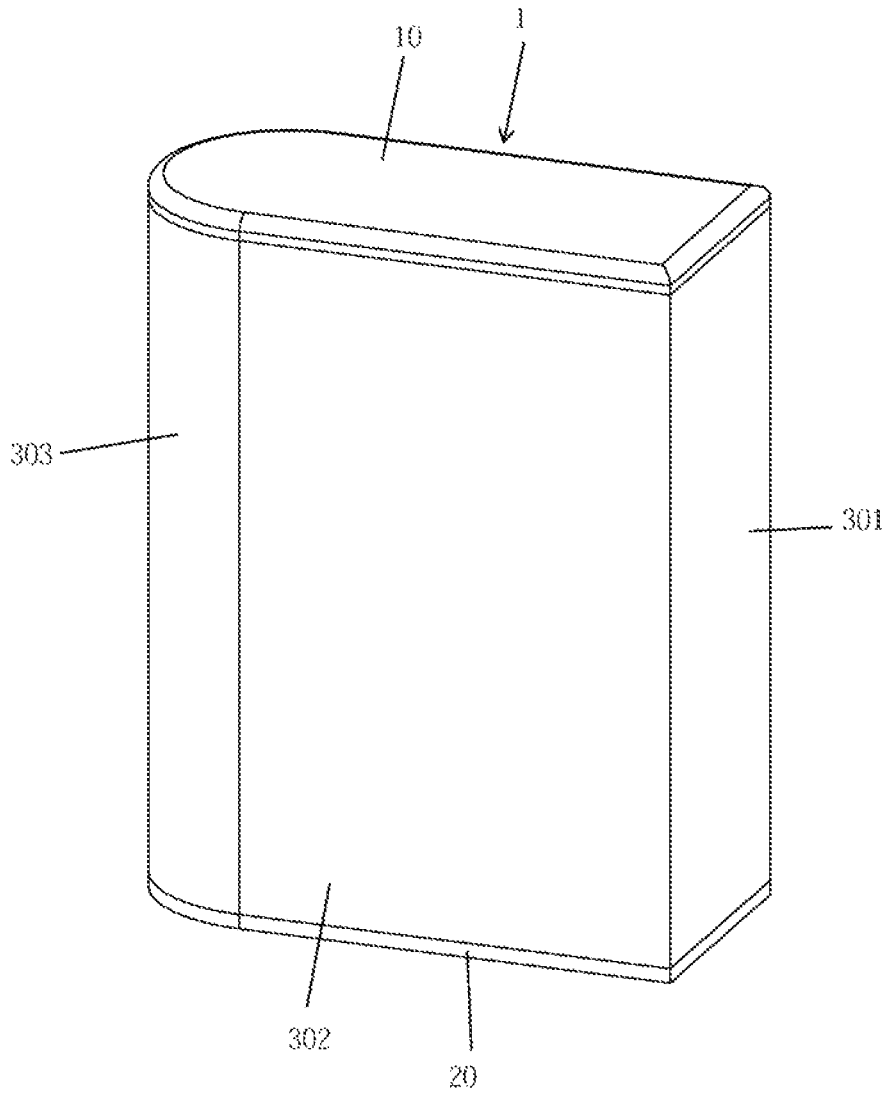
FIG. 8 is a perspective view of an exercising device in accordance with another preferred embodiment of the present invention.
Figure 9:
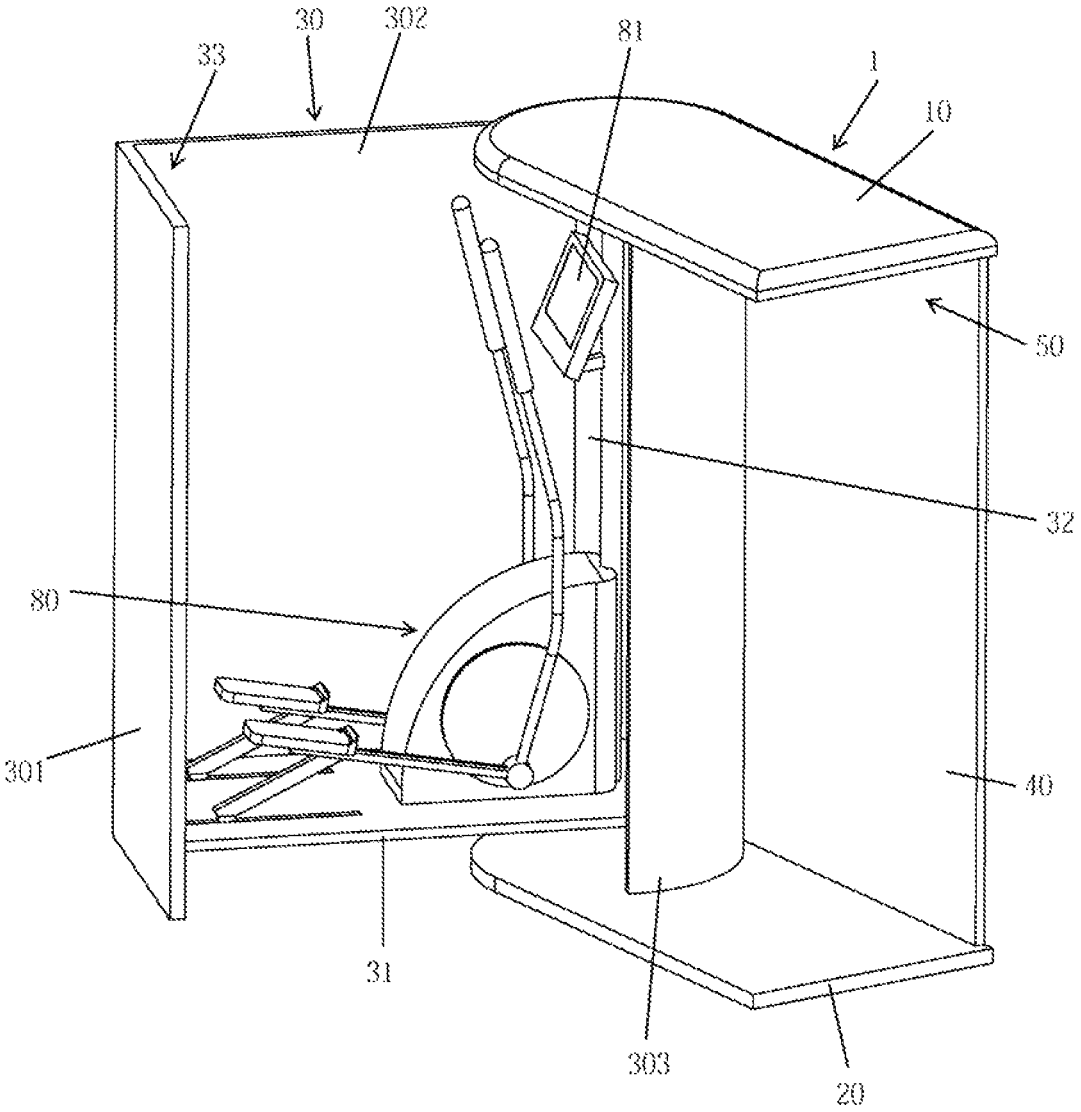
FIG. 9 is a perspective view showing opening of the exercising device as shown in FIG. 8.
Figure 10:
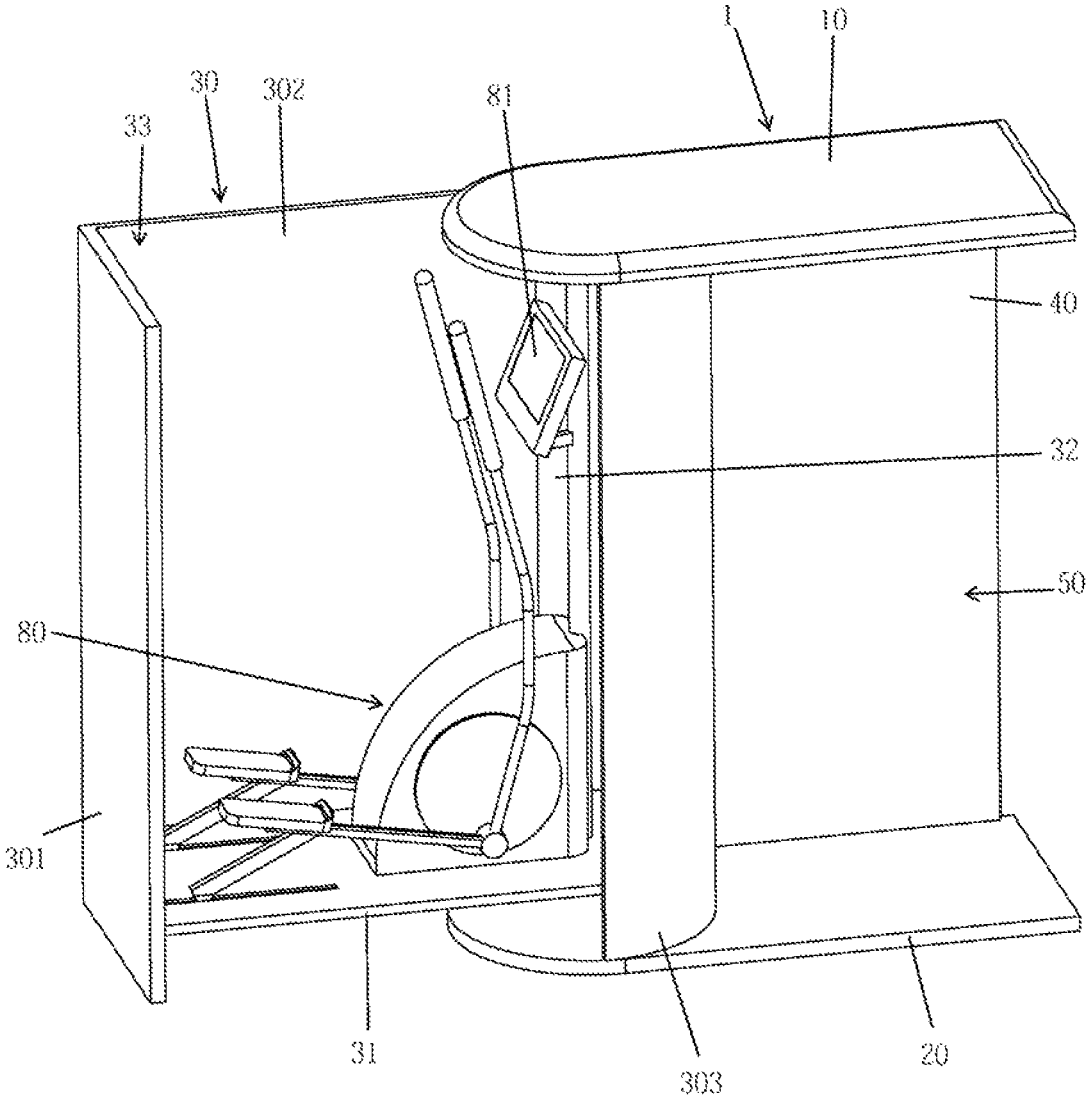
FIG. 10 is a perspective view showing operation of the exercising device as shown in FIG. 8.

Referring to FIGS. 8-10, the exercise apparatus 80 is preferably an elliptic exercise machine.

Figure 11:
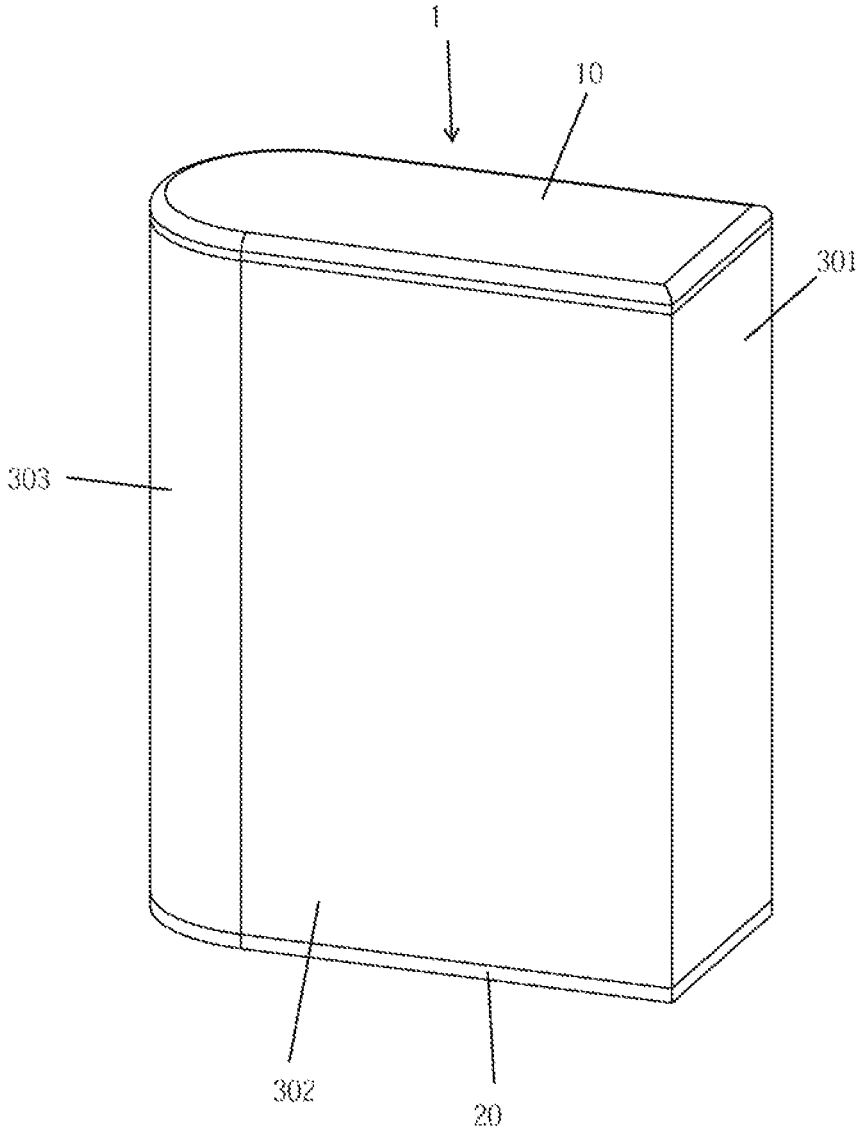
FIG. 11 is a perspective view of an exercising device in accordance with another preferred embodiment of the present invention.
Figure 12:
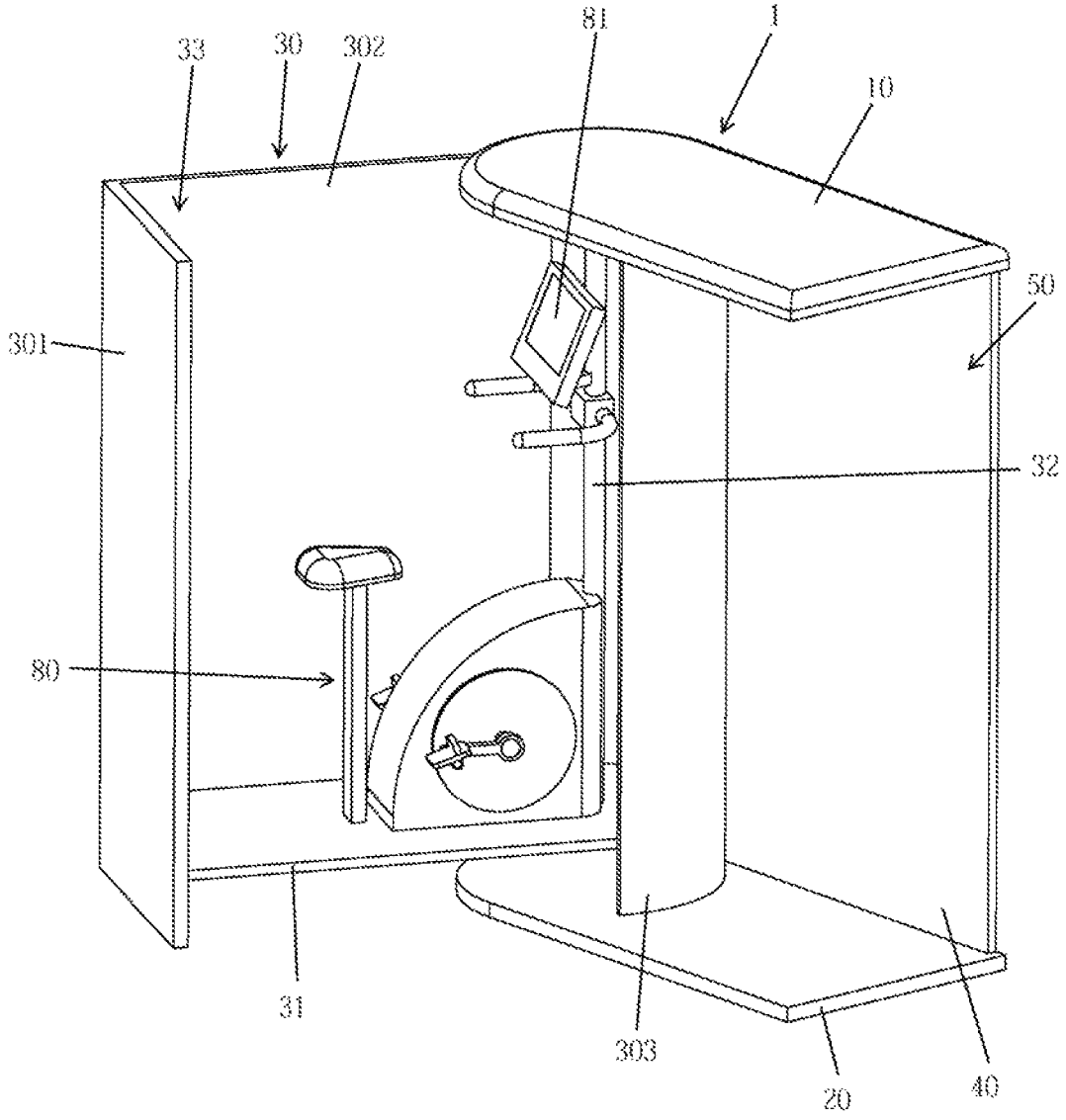
FIG. 12 is a perspective view showing opening of the exercising device as shown in FIG. 11.
Figure 13:
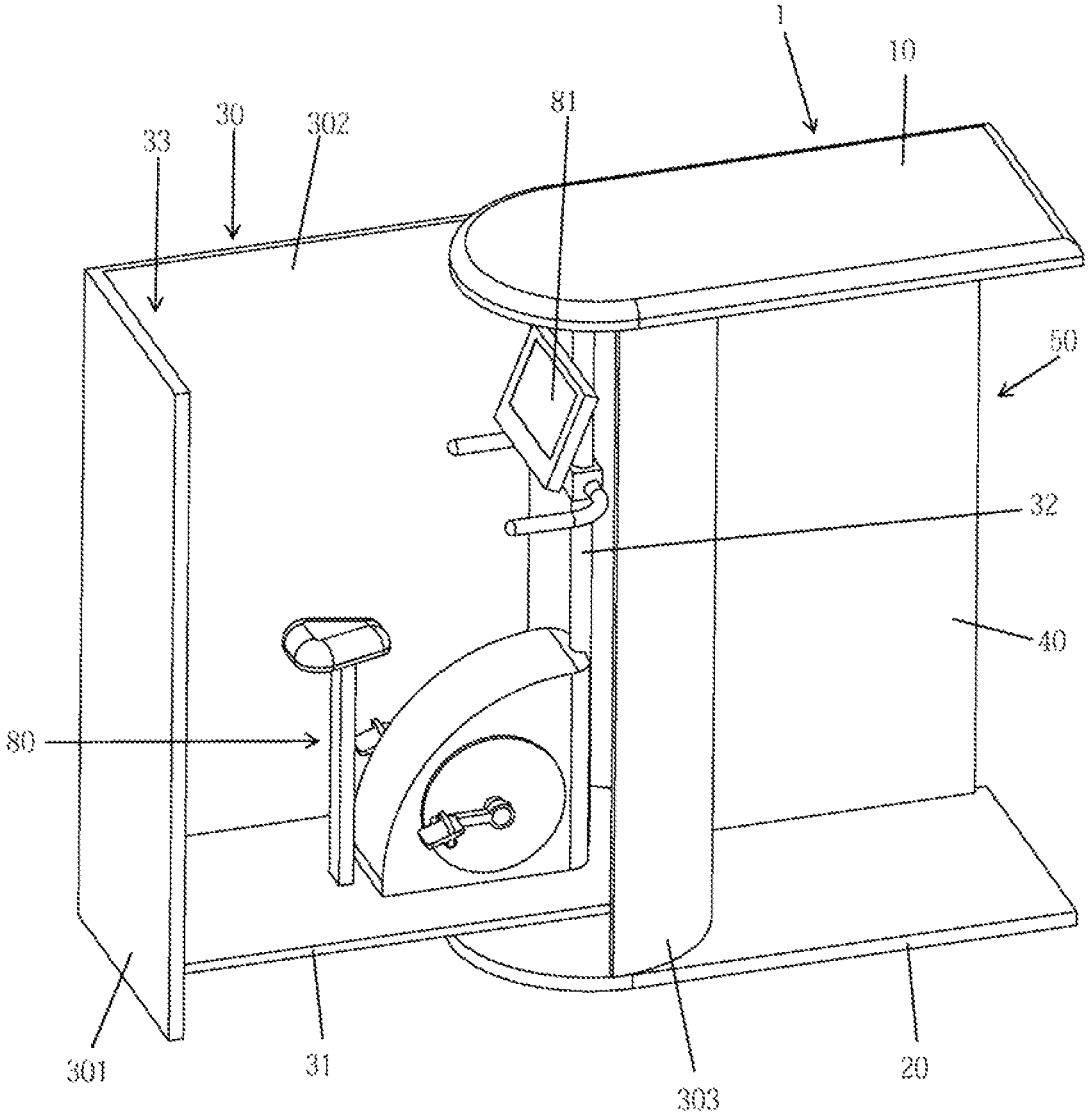
FIG. 13 is a perspective view showing operation of the exercising device as shown in FIG. 11.

Referring to FIGS. 11-13, the exercise apparatus 80 is preferably an exercise bike.

Accordingly, when the user wishes to use the exercise apparatus 80, the movable side 30 of the cabinet 1 is pivoted sideward to open the receiving space 50 of the cabinet 1, such that the user directly operates the exercise apparatus 80 immediately, to perform a corresponding movement, so as to achieve an exercising effect. In addition, when the exercise apparatus 80 is not in use, the movable side 30 of the cabinet 1 is pivoted sideward to close the receiving space 50 of the cabinet 1, and the exercise apparatus 80 is stored in the receiving space 50 of the cabinet 1, such that the exercising device functions as a piece of furniture. Further, the cushion 60 is mounted on the top plate 10 of the cabinet 1, to facilitate the user sitting or lying on the cushion 60. Further, when the movable side 30 of the cabinet 1 closes the receiving space 50 of the cabinet 1, the exercise apparatus 80 is stored in the receiving space 50 of the cabinet 1 and protected by the movable side 30 of the cabinet 1, to achieve dustproof and storage purposes, and to enhance the lifetime of the exercise apparatus 80. Further, the exercise apparatus 80 is stored in the receiving space 50 of the cabinet 1 and does not occupies additional indoor space when not in use. Further, the exercise apparatus 80 is stored easily and conveniently, thereby facilitating the user storing the exercise apparatus 80. Further, the exercising device is adapted to function as furniture, such that the exercising device is incorporated into the house environment, thereby enhancing the aesthetic quality of the house.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. An exercising device comprising:

a cabinet; and an exercise apparatus mounted in the cabinet;

wherein:

the cabinet includes a top plate, a bottom plate, at least one fixed side, and a movable side;

a cushion is mounted on a top of the top plate;

the cabinet has a receiving space defined between and enclosed by the top plate, the bottom plate, the at least one fixed side, and the movable side;

the at least one fixed side of the cabinet has an upper end secured to the top plate, and a lower end secured to the bottom plate;

the movable side of the cabinet is provided with a fixing member;

a pivot member extends through the fixing member of the movable side, and is mounted between the top plate and the bottom plate;

the fixing member of the movable side is pivoted about the pivot member, such that the movable side of the cabinet is pivoted sideward, to close or open the receiving space of the cabinet;

the exercise apparatus is secured on the fixing member of the movable side; and the exercise apparatus is received in the receiving space of the cabinet when the movable side of the cabinet closes the receiving space of the cabinet, and is extended and exposed outward from the receiving space of the cabinet when the movable side of the cabinet opens the receiving space of the cabinet.

2. The exercising device of claim 1, wherein the cabinet is made of wood, plastics, iron or glass.

3. The exercising device of claim 1, wherein the pivot member has an upper end pivotally connected with the top plate, and a lower end pivotally connected with the bottom plate.

4. An exercising device comprising:

a cabinet; and an exercise apparatus mounted in the cabinet;

wherein:

the cabinet includes a top plate, a bottom plate, at least one fixed side, and a movable side;

the cabinet has a receiving space defined between and enclosed by the top plate, the bottom plate, the at least one fixed side, and the movable side;

the at least one fixed side of the cabinet has an upper end secured to the top plate, and a lower end secured to the bottom plate;

the movable side of the cabinet is provided with a fixing member;

a pivot member extends through the fixing member of the movable side, and is mounted between the top plate and the bottom plate;

the fixing member of the movable side is pivoted about the pivot member, such that the movable side of the cabinet is pivoted sideward, to close or open the receiving space of the cabinet;

the exercise apparatus is secured on the fixing member of the movable side;

the exercise apparatus is received in the receiving space of the cabinet when the movable side of the cabinet closes the receiving space of the cabinet, and is extended and exposed outward from the receiving space of the cabinet when the movable side of the cabinet opens the receiving space of the cabinet;

the movable side of the cabinet includes a first side section, a second side section connected with the first side section, and a third side section connected with the second side section;

the movable side of the cabinet has a movement space defined between and enclosed by the first side section, the second side section, and the third side section;

the exercise apparatus is arranged in the movement space of the movable side;

the second side section of the movable side is perpendicular to the first side section, and is located between the first side section and the third side section; and the third side section of the movable side has an arcuate shape.

5. The exercising device of claim 1, wherein the exercise apparatus includes an electronic instrument mounted on a bottom of the top plate of the cabinet.

6. The exercising device of claim 1, wherein the exercise apparatus is a rowing machine, pull exercise machine, a treadmill, an elliptic exercise machine or an exercise bike.

* * * * *